US009560940B1

(12) United States Patent
Evans

(10) Patent No.: US 9,560,940 B1
(45) Date of Patent: Feb. 7, 2017

(54) EMBEDDED SOFTENED LOOFAH

(71) Applicant: Soaps Washing and Grooming Essentials LLC, Houston, TX (US)

(72) Inventor: Lydia Evans, Houston, TX (US)

( * ) Notice: Subject to any disclaimer, the term of this patent is extended or adjusted under 35 U.S.C. 154(b) by 0 days.

(21) Appl. No.: 14/826,124

(22) Filed: Aug. 13, 2015

(51) Int. Cl.
*D06M 13/00* (2006.01)
*A47K 7/03* (2006.01)

(52) U.S. Cl.
CPC ..... *A47K 7/03* (2013.01); *D06M 13/00* (2013.01)

(58) Field of Classification Search
CPC ..... C11D 17/04; D06M 13/00; A47K 7/03
See application file for complete search history.

(56) References Cited

FOREIGN PATENT DOCUMENTS

CN 105670844 A * 6/2016

* cited by examiner

*Primary Examiner* — Shay Karls
(74) *Attorney, Agent, or Firm* — TD Foster; Bruce Hare; Thomas D. Foster

(57) ABSTRACT

Ways to generate softened loofah embedded products are described. Such softened loofah is softened using a softening solution that includes papaya extract, liquid detergent, and water. The softening solution is heated during treatment of the loofah. The softened loofah is pre-rinsed with a solution of bleach and water and/or rinsed with water. The softened loofah is able to be embedded into a cleaning agent such as soap.

8 Claims, 3 Drawing Sheets

EMBEDDED SOFTENED LOOFAH

BACKGROUND

Use of loofah bathing products is ubiquitous in society. Existing products include loofah that is abrasive, coarse, and/or grainy, and therefore not appropriate for sensitive areas such as the face, or for those with sensitive skin.

In addition, existing products may be hard to use with cleansing products such as soap, where a user may find it difficult to generate lather or otherwise utilize the soap.

Therefore, there exists a need for loofah-based bathing and cosmetic products that are soft enough for use on sensitive skin and/or are embedded into appropriate cleansing materials.

SUMMARY

Some embodiments may provide a soap product with embedded loofah. The loofah may include discrete openings that allow water to access the embedded soap, and allow lather to exit the loofah. In addition, exposed portions of the loofah may provide improved cleansing, lathering, exfoliation, etc.

A loofah softening solution of some embodiments may include water, papaya extract, and liquid detergent. The softening solution may be prepared by mixing papaya extract with liquid detergent, and then combining with water. The softening solution may be prepared by mixing and heating the solution (e.g., to one hundred eighty degrees Fahrenheit).

Some embodiments may provide loofah treated with the softening solution to generate soft loofah products. Loofah may be placed and/or held in the softening solution for an appropriate duration. Next, the loofah may be pre-rinsed with a solution including bleach and water, and then rinsed with water. The loofah may then be embedded into a soap base (and/or other appropriate base), resulting in a soft loofah product.

The preceding Summary is intended to serve as a brief introduction to various features of some exemplary embodiments. Other embodiments may be implemented in other specific forms without departing from the scope of the disclosure.

BRIEF DESCRIPTION OF THE SEVERAL VIEWS OF THE DRAWINGS

The novel features of the disclosure are set forth in the appended claims. However, for purpose of explanation, several embodiments are illustrated in the following drawings.

DETAILED DESCRIPTION

The following detailed description describes currently contemplated modes of carrying out exemplary embodiments. The description is not to be taken in a limiting sense, but is made merely for the purpose of illustrating the general principles of some embodiments, as the scope of the disclosure is best defined by the appended claims.

Broadly, an embodiment generally provides a way to generate softened loofah that may be used on facial skin and by people with sensitive skin. Such a loofah may be embedded into soap (and/or other cosmetic products) and may include various components that allow the soap to properly conjoin with the loofah, and which facilitate the passage of water and/or lather through the loofah. Some embodiments may include a softening solution that may be used to soften the loofah. The softening solution may include papaya extract, liquid detergent, and water. Some embodiments may provide ways to soften the loofah with the softening solution and embed the loofah into various bathing and/or cosmetic products (e.g., soap, scrubs, exfoliators, etc.).

A first exemplary embodiment provides a loofah-embedded product. The loofah may be embedded into soap, other cleaning agents, cosmetic products, etc. The loofah may include discrete openings that allow water to access the embedded soap, and allow lather to exit the loofah. The loofah may be composed of porous material that allows it to be properly embedded into soap and facilitates the flow of water into and out of the loofah.

A second exemplary embodiment provides a process for making a softening solution for use with loofah. The softening solution may include water, liquid detergent, and papaya extract. The softening solution may be heated to various temperatures to properly combine the components of the solution. The softening solution may soften a loofah so that it may be used on facial skin and/or sensitive skin.

A third exemplary embodiment provides a process for softening a loofah and embedding the softened loofah into a soap base. The process includes placing the loofah in a softening solution for an appropriate period of time. Next, the loofah may be pre-rinsed in a solution of bleach and water. After pre-rinsing, the loofah may be rinsed with water. Finally, the loofah may be embedded into a soap base and applied to the skin of a user.

Several more detailed embodiments are described in the sections below. Section I provides a description of an exemplary loofah-embedded product. Section II describes an exemplary method of making a softening solution. Section III then describes a method of producing softened loofah and embedding the softened loofah into a base.

I. Loofah-Embedded Product

Figure 1A:
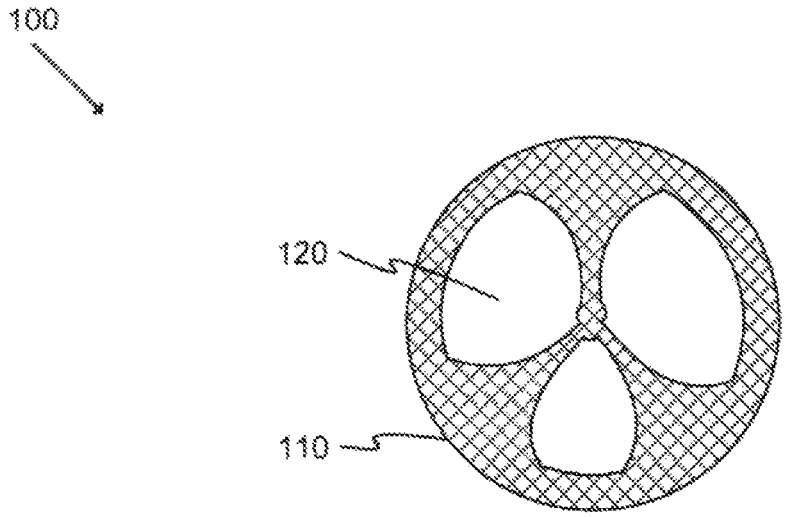
FIG. 1A illustrates a front elevation view of a loofah embedded into soap according to an exemplary embodiment.
Figure 1B:
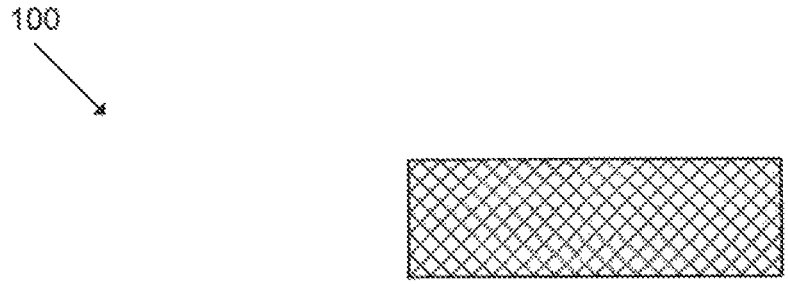
FIG. 1B illustrates a top view of the loofah product of FIG. 1A.

FIG. 1A illustrates a front elevation view of soap with embedded loofah 100 according to an exemplary embodiment. FIG. 1B illustrates a top view of a loofah embedded into soap according to an exemplary embodiment.

The loofah product 100 may include loofah 110 and a base material 120 such as soap. The loofah 110 may be porous material that allows the loofah to be embedded into the soap 120 and allows water to mix with the soap. The loofah 110 may include various pockets, cavities, folds, bristles, and/or protrusions that allow water to adequately flow into and out of the loofah, and to help with overall use of the loofah. The soap 120 may be any appropriate soap base.

The soap may be poured over the loofah 110 to embed the loofah into the soap 120. Open spaces throughout the loofah 110 may allow water to reach the soap 120 and/or allow lather to exit the loofah 110. In addition, any exposed (or partially exposed) portions of the loofah may provide improved cleansing, exfoliation, etc. as compared to soap alone.

One of ordinary skill in the art will recognize that product 100 is presented for exemplary purposes and may be implemented in various different ways without departing from the scope of the disclosure. For instance, the loofah 110 may be embedded into other types of materials (e.g., scrubs, exfoliators, etc.). As another example, multiple loofahs may be embedded into a single base or a smaller portion of loofah may be embedded into the base. In addition, in this example, the soap 120 extends to each outer surface of the loofah 110, also filling any gaps within the loofah. Other embodiments may include soap 120 that extends past the outer surfaces of the loofah 110, and/or soap 120 may not extend to the outer surfaces of the loofah 110, such that only a portion of the loofah is embedded into the base 120.

The loofah may be processed using the softening solution and soap base that are described in further detail below in reference to FIGS. 2 and 3.

II. Softening Solution

Figure 2:
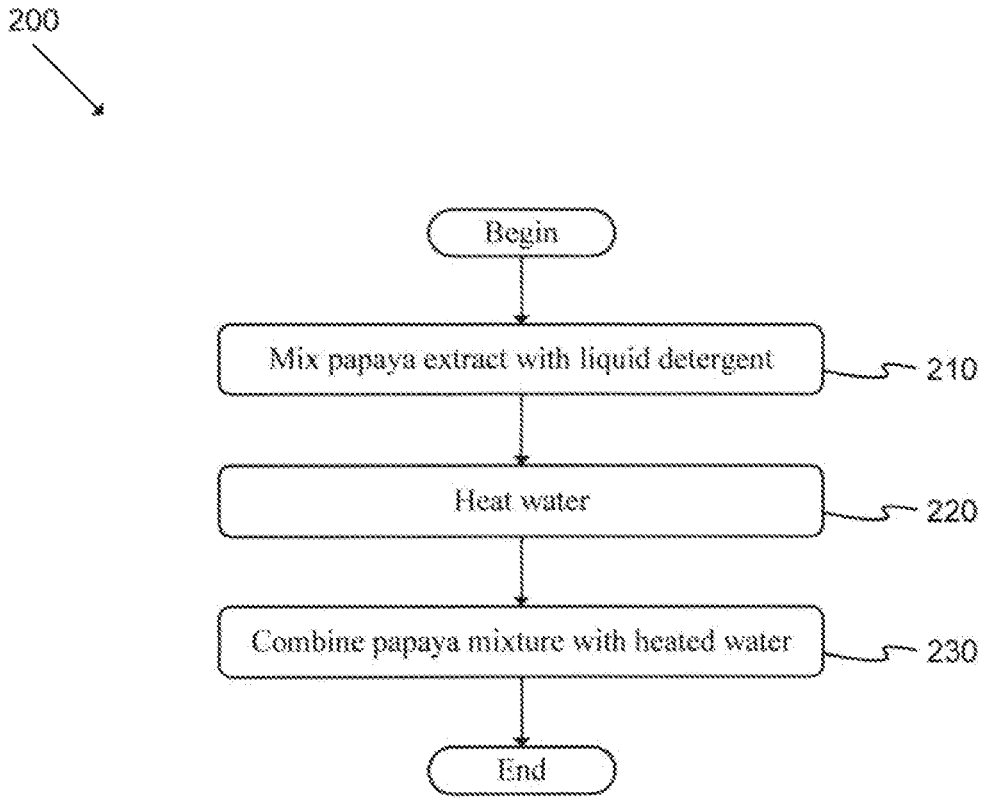
FIG. 2 illustrates a flow chart of an exemplary process used by some embodiments for making a softening solution for use with the loofah of FIG. 1A-1B.

FIG. 2 illustrates a flow chart of a process 200 used by some embodiments for making a softening solution for use with the loofah of FIGS. 1A-1B. The process may begin, for instance, when the components of the softening solution (i.e., water, papaya extract, and liquid detergent) are available.

The process may mix (at 210) papaya extract with liquid detergent. Next, the process may heat (at 220) water to one hundred eighty degrees Fahrenheit. The process may then combine (at 230) the mixture of papaya extract and liquid detergent with the heated water and then may end. In some embodiments, the solution may be held at a desired temperature until and throughout treatment of a loofah. The amount of the papaya extract and liquid detergent mixture combined with water may be fifteen percent of the total volume.

Loofah may be processed using the resulting softening solution. Such processing is described in further detail below in reference to FIG. 3.

One of ordinary skill in the art will recognize that process 200 is exemplary in nature and may be implemented in various different ways without departing from the scope of the disclosure. For instance, the operations may be performed in a different order, various operations may be omitted, and/or other operations may be included. As another example, the softening solution may be heated to various temperatures other than one hundred eighty degrees Fahrenheit (e.g., temperature may be controlled to a range about one hundred eighty degrees, and/or other temperatures may be used depending on humidity, altitude, air density, and/or other appropriate factors). As yet another example, various components may be omitted (e.g., papaya extract and/or liquid detergent) and/or other components may be included (e.g., other fruit extracts, vegetable extracts, solid detergents, other surfactants, etc.).

III. Generation of Loofah Product

Figure 3:
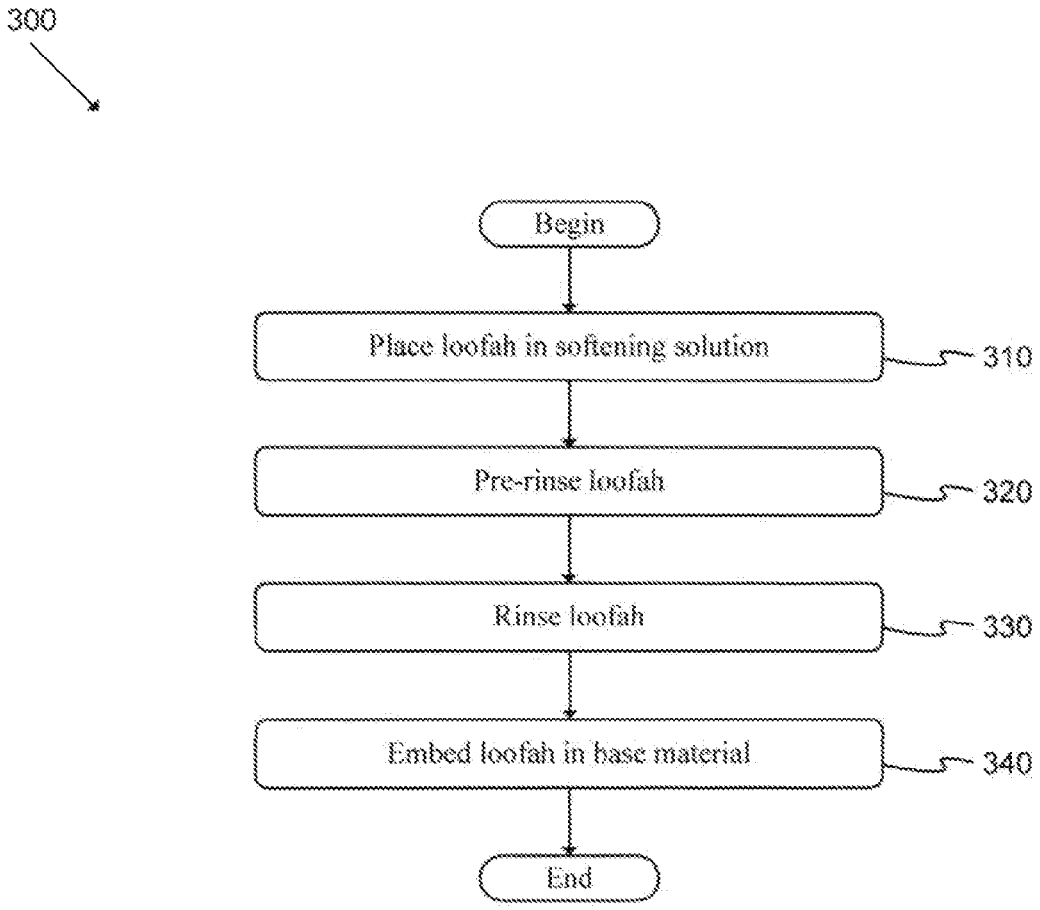
FIG. 3 illustrates a flow chart of an exemplary process used by some embodiments for softening the loofah of FIGS. 1A-1B with the softening solution of FIG. 2, and embedding the softened loofah with a soap base.

FIG. 3 illustrates a flow chart of a process 300 used by some embodiments for softening a loofah, and embedding the softened loofah into a soap base. The process may begin, for instance, when loofah, softening solution, and a soap base are available.

The process may place (at 310) a loofah in a softening solution. The loofah may be placed and/or held in the softening solution for a period of one hour or other appropriate time. Next, the process may pre-rinse (at 320) the loofah in a solution of bleach and water. The solution of bleach and water may include one cup of bleach per gallon of water. The solution may be heated to one hundred eighty degrees Fahrenheit before pre-rinsing the loofah, and held at that temperature during the pre-rinse. The loofah may be pre-rinsed in the solution of bleach and water for thirty minutes or other appropriate time.

The process may then rinse (at 330) the loofah with water. The loofah may be rinsed with straight water from the cold supply. The loofah may be rinsed for an appropriate time to properly remove the pre-rinse solution. The loofah may be rinsed for various appropriate times depending on the level of softness desired. After rinsing with water, the process may embed (at 340) the loofah in a soap base and then may end. The loofah may be embedded in the soap base by pouring the soap base over the softened loofah.

The soap base may include various appropriate elements including, but not limited to, fats, oils, an alkaline solution (e.g., sodium hydroxide or potassium hydroxide), and soap salts. The base of some embodiments may include fragrant elements, cleansing elements (e.g., beads), and/or other appropriate elements (e.g., lotions). The base may further include various decorative elements that may or may not affect the performance or non-visual attributes of the loofah product.

The loofah product may be further processed, depending on the application. For instance, the product may be allowed to cool and harden (or "cure") over a period of time. The hardened product may be divided into portions, etc.

One of ordinary skill in the art will recognize that process 300 is exemplary in nature and may be implemented in various different ways without departing from the scope of the disclosure. For instance, the operations may be performed in a different order, various operations may be omitted, and/or other operations may be included. As another example, the duration of time a loofah is placed in the softening solution may be less than or more than one hour; the pre-rinse solution may include different mixtures of bleach and water; and/or the loofah may be embedded into cosmetic products and/or cleaning agents other than soap. As still another example, multiple loofahs may be processed at the same time.

The foregoing relates to illustrative details of exemplary embodiments and modifications may be made without departing from the scope of the disclosure as defined by the following claims.

I claim:

1. A process for softening a loofah with a softening solution and embedding the loofah into a cleaning agent, the process comprising:

placing the loofah in the softening solution;

pre-rinsing the loofah with a mixture of bleach and water;

rinsing the loofah with water; and embedding the loofah into a cleaning agent.

2. The process of claim 1, wherein the softening solution comprises papaya extract, liquid detergent, and water.

3. The process of claim 1, wherein the cleaning agent comprises a soap base.

4. The process of claim 1, wherein the softening solution is heated to one hundred eighty degrees Fahrenheit.

5. The process of claim 1, wherein the loofah is placed in the softening solution for one hour.

6. The process of claim 1, wherein the pre-rinse solution comprises one cup of bleach for every gallon of water.

7. The process of claim 1, wherein the loofah is pre-rinsed for thirty minutes.

8. The process of claim 1, wherein the loofah is embedded into the soap base by pouring the soap base over the softened loofah.

* * * * *